United States Patent [19]

Glecker et al.

[11] 4,096,728

[45] Jun. 27, 1978

[54] ADJUSTING DEVICE FOR SLIDE DRIVEN LIFT OUT ACTUATORS

[75] Inventors: Donald Leroy Glecker; John F. Roth, both of Salem, Ohio; Peter N. Bosch, Kentwood, Mich.

[73] Assignee: Gulf & Western Manufacturing Company, Southfield, Mich.

[21] Appl. No.: 819,489

[22] Filed: Jul. 27, 1977

[51] Int. Cl.[2] ..... B21D 45/00

[52] U.S. Cl. ..... 72/345; 72/35; 72/446; 100/257

[58] Field of Search ..... 72/32, 35, 344, 345, 72/427, 441, 446, 452; 83/522, 527; 100/257, 282

[56] References Cited

U.S. PATENT DOCUMENTS

| | | | |
|---|---|---|---|
| 2,793,584 | 5/1957 | Pearson | 100/257 X |
| 2,818,798 | 1/1958 | Deykin | 100/257 |
| 3,687,069 | 8/1972 | Helrigel | 72/446 X |
| 3,726,123 | 4/1973 | Bothe | 72/345 |
| 4,033,252 | 7/1977 | Baker | 100/257 X |

*Primary Examiner*—Leon Gilden
*Attorney, Agent, or Firm*—Meyer, Tilberry & Body

[57] ABSTRACT

The bed of a press is provided with a workpiece ejecting mechanism including actuating rods attached to the press slide for displacement therewith to actuate the lift out mechanism. The press slide is provided with a motor driven shut height adjusting mechanism, and the actuating rods of the ejecting mechanism are interengaged with the slide by means of corresponding adjusting mechanisms which are driven by and in synchronism with the shut height adjusting mechanism.

15 Claims, 9 Drawing Figures

ADJUSTING DEVICE FOR SLIDE DRIVEN LIFT OUT ACTUATORS

The present invention relates to the art of presses and, more particularly, to an improvement in connection with workpiece ejecting mechanisms actuated in response to slide displacement.

In connection with the production of metal workpieces, such as by the shaping of a blank between cooperable die assemblies on a press bed and slide, it is often desirable to provide a workpiece ejecting mechanism which operates following the forming operation to displace the formed workpiece from one of the die assemblies. Arrangements heretofore provided for this purpose have included mechanically operated mechanisms which are actuated in response to displacement of the press slide relative to the press bed to achieve workpiece ejection at a given time during movement of the slide away from the bed following a forming operation. The ejector mechanism may of course be either in the press bed or in the slide, depending on the nature of the workpiece being formed and the die assemblies by which forming is achieved.

It is also known to provide presses with adjustable slides for varying the shut height of the slide relative to the press bed. In connection with a press having such an adjustable slide and a workpiece ejector mechanism which is actuated in response to relative displacement between the slide and bed, it will be appreciated that adjustment of the shut height of the slide causes a change in the position of the slide along its path of movement at which ejection of the workpiece occurs. Timing with respect to ejection of a workpiece is an important consideration in connection with the ability to operate a press efficiently and at an optimum production rate. In this respect, actuation of the ejecting mechanism too soon following the forming operation may result in damage of the formed workpiece or the forming die assemblies. A delay in the ejection action can require a slow down in the stroke rate to provide sufficient time for removal of a formed workpiece and insertion of a blank between the die components for the subsequent forming operation. Accordingly, it is desirable to provide for the actuating components of a mechanical workpiece ejecting mechanism to be adjustable so that the timing of ejection can be coordinated with a desired slide position whenever it becomes necessary or desirable to adjust the shut height of the slide for various purposes, such as operation with different dies.

Heretofore, in connection with mechanical workpiece ejector mechanisms, such adjustment of the ejector mechanism for the foregoing purpose has been accomplished manually and, accordingly, such adjustment must be made each time the shut height is altered. Accuracy with regard to adjusting the ejector mechanism is extremely important, whereby manual adjustment has required trained personnel to perform the necessary adjustments. The manual procedure is time consuming in man hours in that the adjustment must be made carefully and then checked for accuracy. Often several adjustments and checks must be made to be sure that operation of the press will result in ejection at the desired time and at the slide position following the forming operation and to be sure that an adjustment has not been made which will cause interference between component parts and thus possible damage to the press and die assemblies. It will be appreciated, therefore, that even with trained personnel the procedure is very time consuming. It will be further appreciated that the down time required for making these adjustments results in a loss of production time and, thus, an increase in production costs.

In accordance with the present invention, the foregoing and other disadvantages attendant to adjustment of mechanically actuated workpiece ejector mechanisms are avoided by providing an adjustment arrangement for the ejector mechanism which does not require trained personnel to perform the adjusting arrangement and by which adjustment of the ejector mechanism is positionally coordinated with an adjustment of the slide shut height both accurately and quickly to minimize down time of the press. Preferably, the slide shut height and actuating components of the ejector mechanism are adjusted simultaneously and in synchronism such that any adjustment of the shut height results in a corresponding and proper adjustment of the ejector mechanism. This can be achieved, for example, by mechanically coupling the shut height adjusting mechanism and an adjusting mechanism for the actuators of the workpiece ejecting mechanism such that adjustment of the shut height is accompanied by the coordinated adjustment of the ejector mechanism. In the preferred embodiment, the shut height mechanism is driven to adjust the shut height and also the ejector relationship.

It is an outstanding object of the present invention to provide a press having a mechanically actuated ejector mechanism with an improved arrangement for adjusting the ejector mechanism in coordination with adjustments of the shut height of the press slide.

It is another object to provide a press of the foregoing character with an adjusting arrangement for the ejector mechanism which is interrelated with a slide shut height adjusting mechanism to enable quick and accurate positional adjustment of the ejector mechanism to a position coordinated with the position of the press slide following adjustment of the slide shut height.

A further object is the provision of a press of the foregoing character with mechanically interrelated shut height and ejector adjustment mechanisms providing synchronized adjustment of the ejector mechanism in response to adjustment of the shut height.

Still another object is the provision of a press of the foregoing character having shut height and ejector mechanisms mechanically interrelated to enable shut height and ejector mechanism adjustments to be achieved simultaneously, accurately and in a minimum amount of time, thus to minimize loss of production with the press.

The foregoing objects, and others, will in part be obvious and in part pointed out more fully hereinafter in conjunction with the written description of a preferred embodiment of the invention shown in the accompanying drawings in which.

Figure 1:
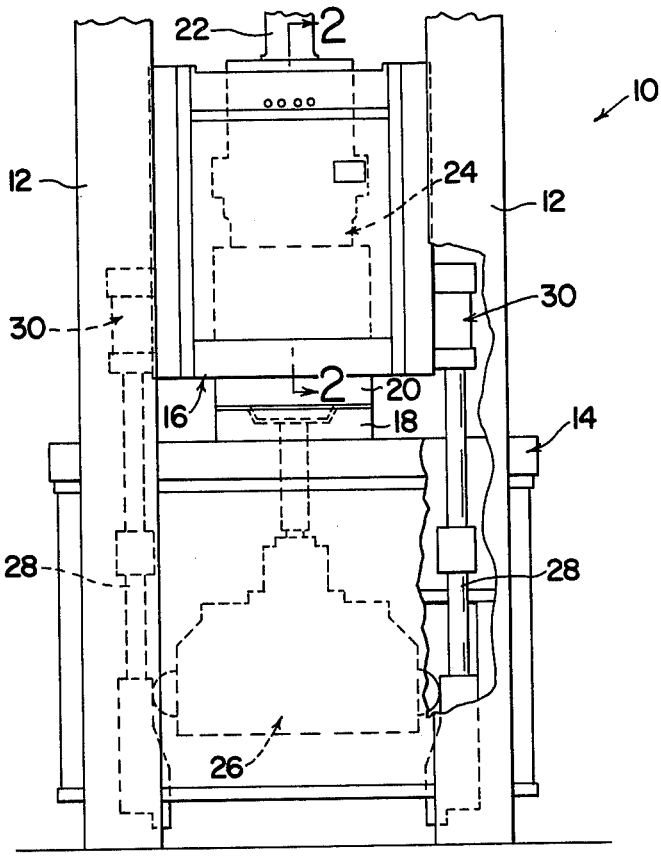
FIG. 1 is an elevation view of a press incorporating a shut height and ejector mechanism adjustment arrangement in accordance with the present invention.

Referring now in greater detail to the drawings wherein the showings are for the purpose of illustrating a preferred embodiment of the invention only and not for the purpose of limiting the invention, FIG. 1 shows a press 10 having a frame including uprights 12 and a bed 14. The press further includes a slide 16 supported for reciprocation by uprights 12 toward and away from bed 14. As is well known, bed 14 and slide 16 are adapted to be provided with cooperable die assemblies 18 and 20, respectively, cooperable in response to movement of slide 16 toward the press bed to engage and form a blank position between the die assemblies. It will be appreciated that slide 16 is adapted to be reciprocated by means of a mechanical drive arrangement including a slide link member 22 pivotally connected to the slide as described hereinafter. Details with regard to the press drive are not important for an understanding of the present invention and accordingly are not shown in detail. By way of example, however, it will be appreciated that slide link 22 could be connected to a crank so as to reciprocate slide 16 in response to rotation of the crank.

Slide link member 22 is connected to slide 16 through a shut height adjusting mechanism 24 which is described in detail hereinafter and which enables adjustment of the slide axially relative to slide link member 22 and, thus, relative to press bed 14. The press further includes a workpiece ejector mechanism 26 which is described in detail hereinafter and which enables ejection of a workpiece from die assembly 18 during upward movement of slide 16 following a forming operation. As will become apparent hereinafter, ejector mechanism 26 is actuated in response to reciprocating movement of slide 16 and through a pair of actuator rods 28 attached to the slide for displacement therewith. As described in greater detail hereinafter, each actuator rod 28 is interconnected with slide 16 by means of a corresponding actuator rod adjusting mechanism 30. Adjusting mechanisms 30 are drivable to axially adjust the position of the corresponding actuator rod 28 relative to slide 16, and the axial adjustment of each actuator rod 28 is coordinated with adjustment of the slide shut height by adjusting mechanism 24. Accordingly, any adjustment of the slide shut height is accompanied by an adjustment of actuator rods 28 relative to the slide so as to maintain a desired positional relationship of the actuator rods relative to ejector mechanism 26.

Figure 3:
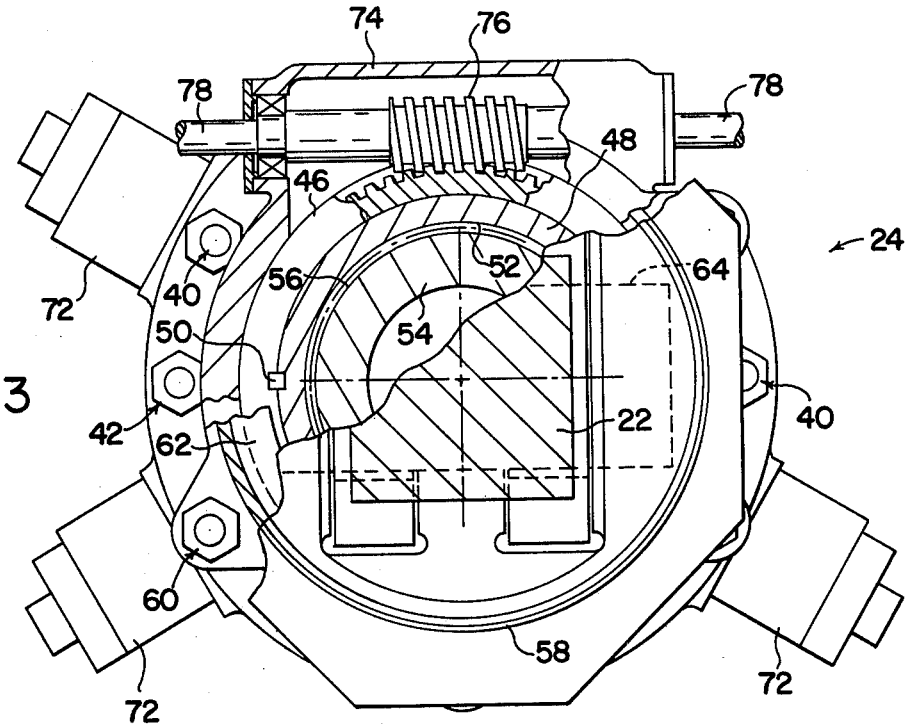
FIG. 3 is an enlarged, detailed partial sectional elevation view of the shut height adjusting mechanism of the press and taken generally along line 3—3 of FIG. 2.
Figure 2:
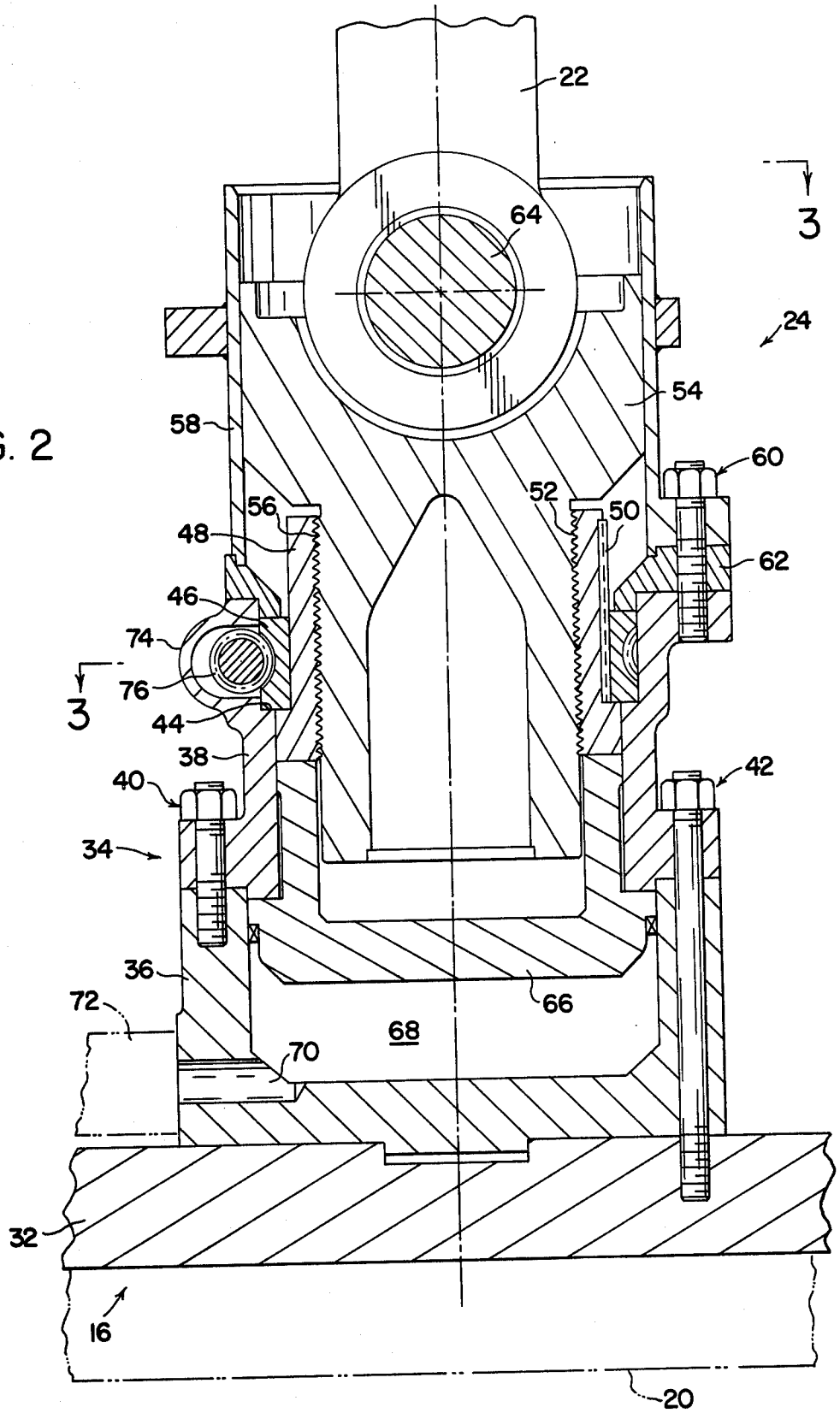
FIG. 2 is an enlarged, detailed partial sectional elevation view of the shut height mechanism of the press and taken generally along line 2—2 of FIG. 1.

Shut height adjusting mechanism 24 and the manner in which slide 16 is connected to slide link member 22 will be best understood with reference to FIGS. 2 and 3 of the drawing. In this respect, slide assembly includes a slide plate member 32 on which die assmebly 20 is adapted to be mounted and which is connected with slide link member 22 through shut height adjustment mechanism 24. In the embodiment disclosed, the shut height adjusting mechanism includes a cylinder type housing assembly 34 comprised of a lower cup-shaped portion 36 and an upper sleeve portion 38. Housing portions 36 and 38 are interconnected by a plurality of fastener assemblies 40 and are attached to slide plate 32 by means of a plurality of fastener assemblies 42. Sleeve portion 38 includes an internal shoulder 44 receiving and supporting a worm wheel 46 for rotation relative to the housing. An adjusting nut sleeve 48 is disposed within worm wheel 46 and is interengaged therewith by means of a key 50 so that sleeve 48 rotates with worm wheel 46 but is free to move axially relative thereto. Sleeve 48 is provided with internal threads 52 and receives the lower end of an adjusting screw member 54, which lower end of member 54 is provided with external threads 56 in meshing engagement with threads 52. An annular sleeve 58 surrounds the upper portion of adjusting screw 54 and is attached to housing 34 by means of fastener assemblies 60. Worm wheel 46 is axially retained in housing 34 by means of an annular member 62 which is sandwiched between the upper end of housing portion 38 and the lower end of sleeve 58. The upper end of adjusting screw 54 is pivotally interconnected with slide link member 22 by means of a pin 64 extending through corresponding openings in the adjusting screw and link member. In the embodiment disclosed, a piston member 66 is received in lower housing portion 36 to define a hydraulic fluid receiving chamber 68 therewith adapted to receive hydraulic fluid and having outlet passages 70 connected to corresponding pressure relief valve assemblies 72 to provide overload protection for the press as set forth hereinafter. Upper portion 38 of housing 34 includes a portion 74 which receives and supports a worm gear 76 threaded for driving interengagement with worm wheel 46. Worm gear 76 includes shaft portions 78 extending from the opposite ends of housing portion 74 to enable driving of the worm gear as set forth hereinafter.

From the foregoing description, it will be appreciated that rotation of worm gear 76 imparts rotation to worm wheel 46 relative to housing 34 and rotation of adjusting screw sleeve 48 therewith through key 50. It will be further appreciated that rotation of sleeve 48 relative to adjusting screw 54 which is held against rotation by slide link member 22 causes axial displacement of housing 34, sleeve 58 and piston 66 relative to adjusting screw 54, thus to adjust the position of slide 16 relative to the press bed. It will be further appreciated that if, during use of the press, an overload is applied to the slide in the direction toward adjusting screw 58 pressure relief valve 72 will operate to release hydraulic fluid from chamber 68 to remove the overload. In this respect, the relief of fluid from chamber 68 allows housing assembly 34, worm wheel 46 and sleeve 58 to move upwardly relative to piston 66 and adjusting screw 54. While a particular shut height adjusting mechanism is shown and includes overload protection for the press slide, it will become apparent hereinafter that other shut height adjusting arrangements can be employed and that overload protection, while preferred, is not essential in connection with the present invention.

Figure 4:
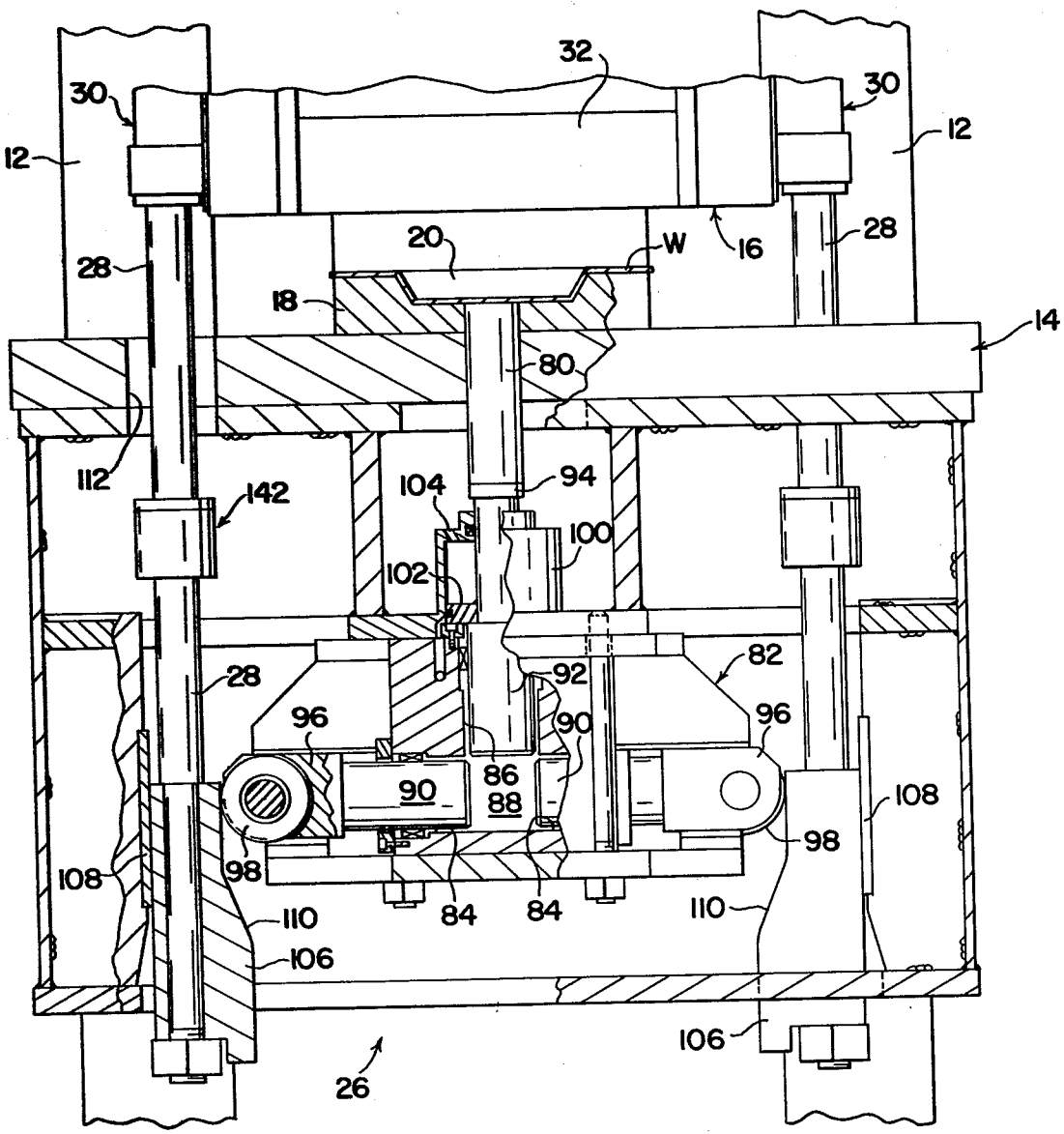
FIG. 4 is an enlarged view, in partial section, of the ejector mechanism of the press shown in FIG. 1.
Figure 5:
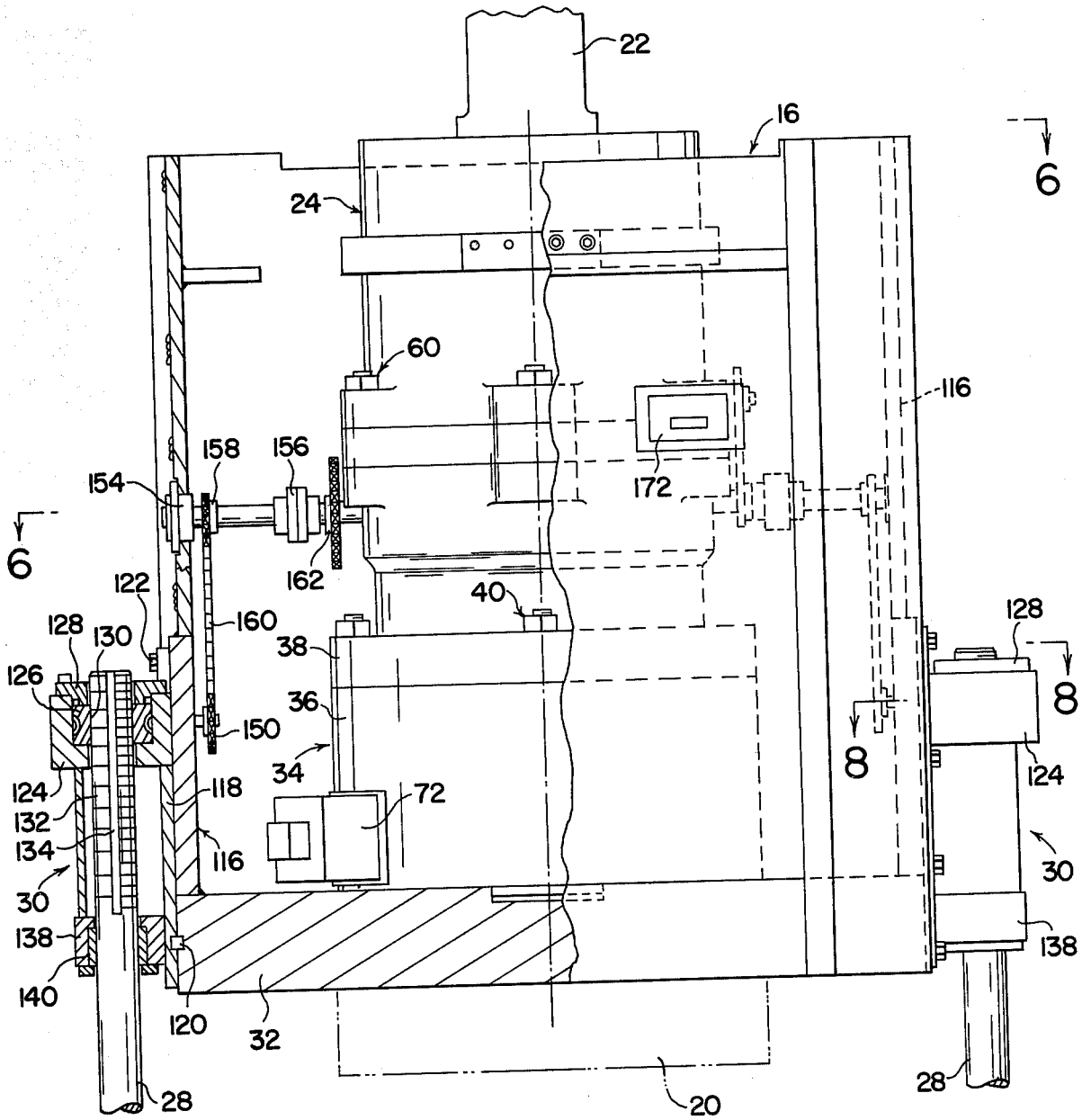
FIG. 5 is a detailed, partially sectioned, elevation view of the adjusting mechanism for the actuator rods of the ejector mechanism of the press shown in FIG. 1.

Workpiece ejector mechanism 26 will be best understood by reference to FIG. 4. To facilitate this description, slide plate member 32 and, thus, actuator rods 28 are shown in the positions thereof corresponding to the bottom dead center position of the press slide 16. Referring now to FIG. 4, ejector mechanism 26 is mounted in the press frame beneath bed 14 and includes an ejector member 80 extending through an opening in die assembly 18 to engage the underside of a workpiece W formed between die assemblies 18 and 20. Ejector mechanism 26 further includes a housing 82 which provides a pair of horizontally opposed cylinders 84 and a vertical cylinder 86, which cylinders 84 and 86 open into a common hydraulic fluid receiving chamber 88. Cylinders 84 slidably receive corresponding piston members 90 and cylinder 86 receives a piston member 92 having an upper end 94 either engaging or connected with ejector member 80. The outer ends 96 of pistons 90 are of noncircular cross section and are supported by housing 82 for reciprocation in axially opposite directions. Further, outer ends 96 are provided with corresponding follower rollers 98 which are suitably pinned to the outer ends for rotation relative thereto. The upper end of ejector piston 92 extends through a housing member 100 and carries a piston member 102 which slidably engages the inner surface of housing 100. Housing 100 is provided with an entrance opening 104 for the chamber to receive air under pressure from a suitable source, not shown, which is operable to bias piston 102 and thus ejector piston 92 to the position thereof illustrated in FIG. 4. Pistons 90 and 92 are normally in the position shown in FIG. 4 and chamber 86 is completely filled with a suitable hydraulic fluid. It will be appreciated, therefore, that axial displacement of pistons 90 simultaneously toward one another results in upward displacement of ejector piston 92 and, thus, ejection of a formed workpiece from die assembly 18 by ejector member 80. It will be further appreciated that upward displacement of ejector piston 92 displaces piston 102 upwardly within housing 100 against the bias of air under pressure behind piston 102, whereby release of pistons 90 for displacement away from one another allows the air under pressure in housing 100 to bias piston 102 and thus ejector piston 92 downwardly for the hydraulic fluid in chamber 86 to bias pistons 90 outwardly.

Inward displacement of pistons 90 to achieve workpiece ejection in the foregoing manner takes place during movement of the press slide upwardly following the forming operation. In this respect, the lower ends of actuator rods 28 are provided with cams 106 which are mounted on the actuator rods for vertical displacement therewith relative to the ejector mechanism. Suitable guides 108 are provided to stabilize movement of the cams, and the opposed inner surfaces of the cams are provided with cam tracks 110 which are engaged by the corresponding follower rollers 98 during reciprocating movement of the actuator rods. The actuator rods extend upwardly through corresponding openings 112 in the press bed and, as mentioned hereinabove, are connected to the slide for movement therewith by means of the corresponding actuating rod adjusting mechanism 30 mounted on the slide. It will be appreciated, therefore, that upward movement of the slide and, thus, upward movement of slide plate 32 from the position shown in FIG. 4 displaces actuator rods 28 upwardly for cam tracks 110 to engage and displace pistons 90 axially inwardly toward one another. It will be further appreciated that during the subsequent downward movement of the slide toward the press bed actuator rods 28 are displaced downwardly so that cam tracks 110 move downwardly to the positions shown in FIG. 4 allowing pistons 90 to move axially outwardly to the positions shown under the influence of air under pressure behind piston 102 in housing 100.

It will be appreciated that the vertical positions of cams 106 relative to follower rollers 98 is important to assure proper operation of the ejector mechanism in connection with displacement of the slide of the press toward and away from bed 14, and that a desired positional relationship must be maintained in the event that the shut height of the slide is changed in order to assure maintaining proper operation of the ejector mechanism. In this respect, for example, if the slide is adjusted toward the press bed to reduce the shut height actuator rods 28 and thus cams 106 are displaced vertically downwardly a corresponding distance. From FIG. 4, it will be seen that such downward movement of the actuator rods could displace cams 106 from engagement with follower rollers 98 when the slide is in its lowermost position, thus subjecting the component parts to damage by improper interengagement therebetween in an ejecting operation. Even if the upper portion of the cam track were extended to prevent such disengagement with the follower rollers, it will be appreciated that the follower rollers could be positioned a distance from the inclined portion of the corresponding cam track which would undesirably delay actuation of the ejector mechanism during the ensuing upward movement of the press slide. As another example, if the press slide is adjusted upwardly away from the press bed, corresponding displacement of actuator rods 28 would position the inclined portions of the cam tracks closer to the follower rollers than the positions shown in FIG. 4. Accordingly, movement of the slide upwardly from the lowermost position thereof following a forming operation would result in immediate actuation of the ejector mechanism which could damage the workpiece and/or component parts of the ejector mechanism and die assemblies by displacement of the ejector member and workpiece into engagement with the die assembly on the slide. Accordingly, the axial positions of the actuator rods and, thus, cams 106 must be adjusted in accordance with any change in the shut height of the slide to maintain the desired positional relationships between the actuating cams and follower rollers to avoid the possibility of improper operation of the foregoing character.

In the embodiment herein disclosed, such axial adjustment of the actuator rods and cams is achieved simultaneously with and in positional synchronism with adjustment of the slide shut height. This adjustment capability will be best understood by referring to the illustrations in FIGS. 5–9 of the drawing. In this respect, and as mentioned herein with regard to FIG. 1 of the drawing, the upper end of each actuator rod 28 is interconnected with slide 16 for reciprocating movement therewith by means of a corresponding actuator rod adjusting mechanism 30. As will be seen from FIGS. 5–9, the press slide includes slide plate assemblies 116 suitably attached to slide plate 32 such as by welding. Each actuator rod adjusting assembly 30 includes a mounting bracket portion 118 mounted on a corresponding one of side plate assemblies 116 by means of a locating key 120 and a plurality of threaded fasteners 122. Each mounting bracket 118 includes an upper cup-shaped portion 124 which receives and rotatably supports a corresponding worm wheel 126, best shown in FIGS. 8 and 9, which is axially retained in place therein by means of a retainer ring 128 fastened to the upper end of cup-shaped portion 124. Worm wheel 126 is provided with internal threads 130 and the upper end of each actuator rod 28 is provided with mating external threads 132. Further, the upper end of each rod 28 is provided with an axially extending linear slot 134, and an anti-rotation key 136 is fastened to retainer 128 and is received in slot 134. The lower portion of bracket assembly 118 includes a journal portion 138 through which the corresponding actuator rod extends and which supports a bearing sleeve 140 to facilitate sliding displacement of the actuator rod relative to the bracket assembly. It will be appreciated from the description thus far that rotation of worm wheel 126 in opposite directions imparts reciprocating movement to the corresponding actuator rod in axially opposite directions relative to the press slide. Preferably, each actuator rod 28 is in sections interengaged by suitable releasable coupling arrangement such as that designated generally by the numeral 142 in FIG. 4, which coupling facilitates assembly and maintenance operations with respect to the ejector mechanism and actuator rod adjusting mechanism.

Figure 6:
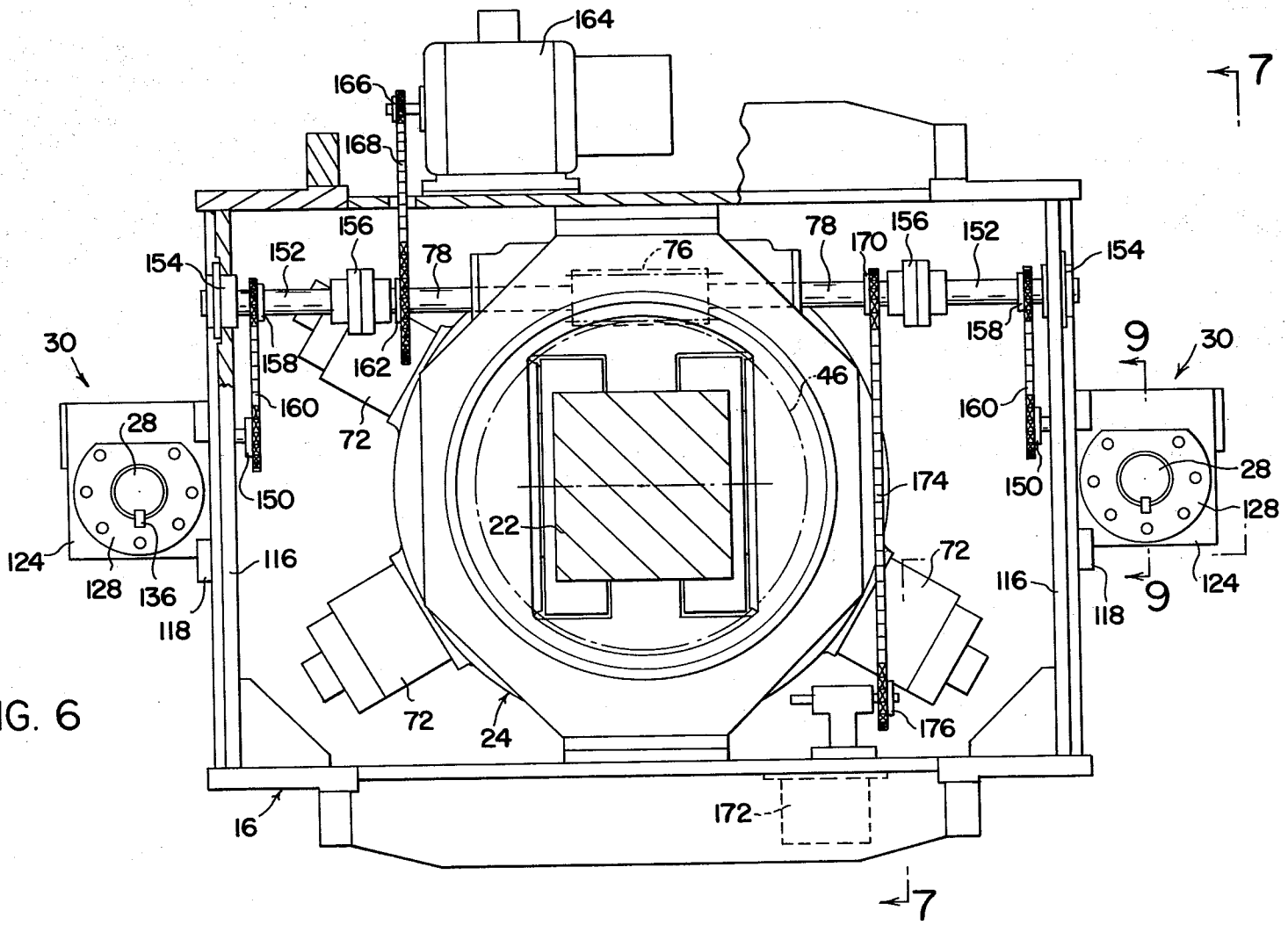
FIG. 6 is a plan view, in partial section, of the shut height and ejector mechanism adjusting arrangements taken generally along line 6—6 in FIG. 5.
Figure 7:
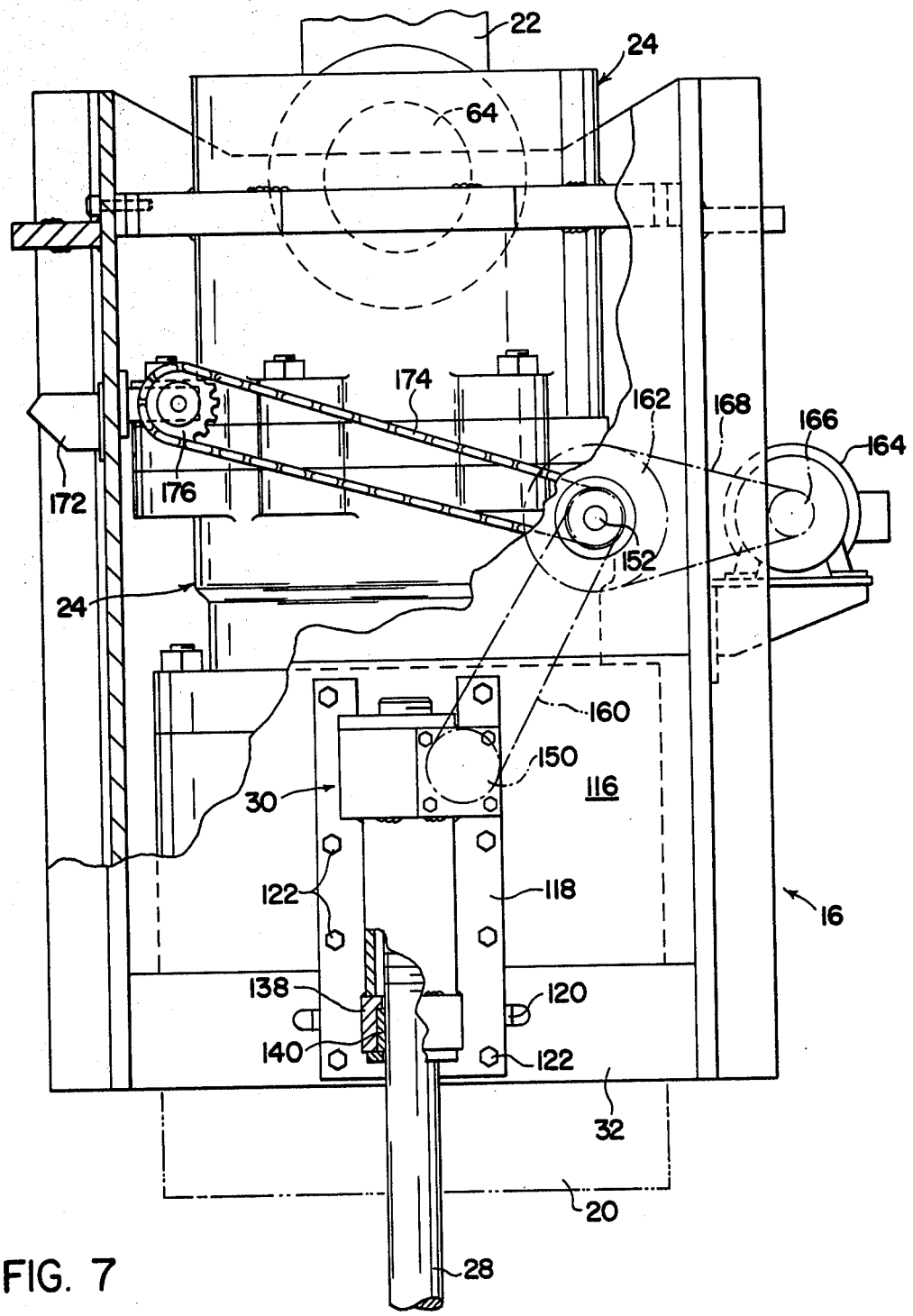
FIG. 7 is a side elevation view of the shut height and ejector adjusting arrangement taken generally along line 7—7 in FIG. 6.
Figure 8:
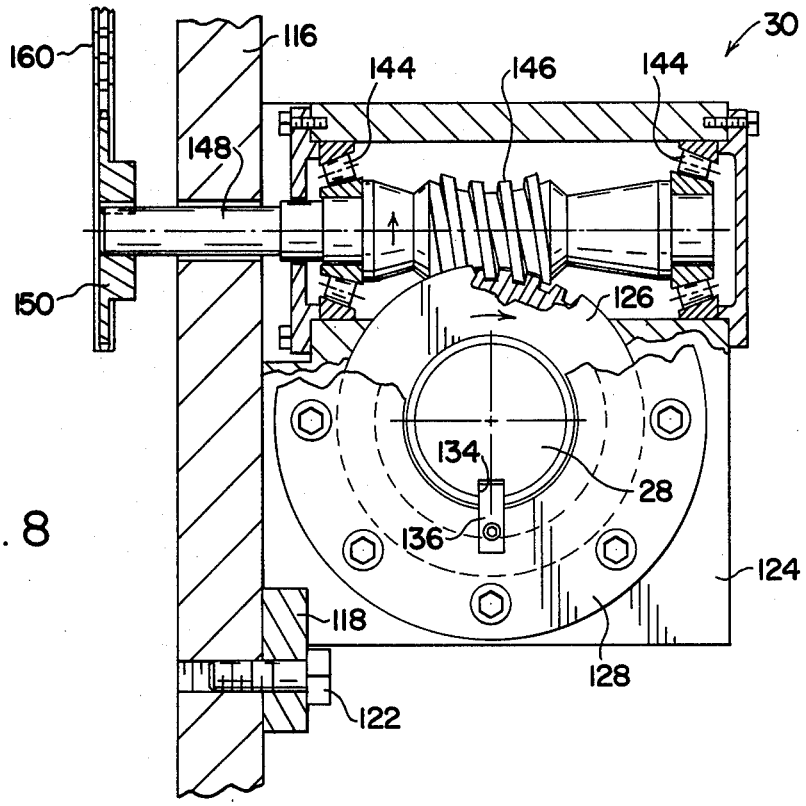
FIG. 8 is an enlarged plan view, in partial section, of the adjusting mechanism for the ejector actuator rods taken generally along line 8—8 in FIG. 5; and, FIG. 9 is an enlarged elevation view, in partial section, of the adjusting mechanism for the ejector actuating rods taken generally along line 9—9 in FIG. 6.
Figure 9:
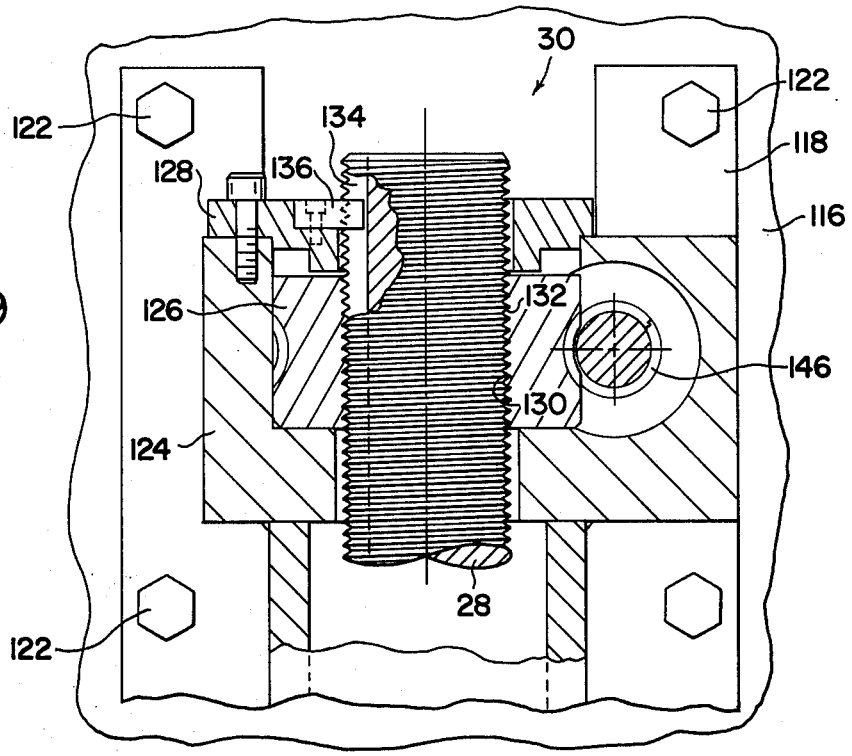

Upper portion 124 of each mounting bracket assembly 118 is provided with bearing assemblies 144 rotatably supporting a worm gear 146, shown in FIGS. 8 and 9, and having teeth in meshing engagement with the corresponding worm wheel 126. The inner end of each worm gear includes a shaft 148 extending through the corresponding side plate assembly 116 and provided on its inner end with a sprocket wheel 150. As mentioned hereinabove, in conjunction with the description of FIGS. 2 and 3 of the drawing, worm gear 76 of the shut height adjusting mechanism 24 has opposite shaft ends 78. As seen in FIG. 6, the slide assembly is provided with a pair of shafts 152 each axially aligned with one end 78 of worm gear 76. The outer ends of shafts 152 are rotatably supported by the corresponding side plate assembly 116 of the slide by suitable bearing assemblies 154. The inner ends of the shaft are drivingly interconnected with the corresponding end 78 of worm gear 76 by couplings 156. Each shaft 152 is provided with a sprocket wheel 158 aligned with the sprocket wheel 150 of the corresponding actuator rod adjusting mechanism and drivingly interconnected therewith by a suitable sprocket chain 160. Accordingly, it will be appreciated that rotation of worm gear 76 of the shut height adjusting mechanism results in simultaneous rotation of worm gears 146 of actuator rod adjusting mechanisms 30. It will be further appreciated that simultaneous rotation of worm gears 76 and 146 displaces slide assembly 16 relative to the press bed and simultaneously displaces actuator rods 28 relative to the slide assembly. The direction of displacement of course depends on the direction of rotation of the worm gears. Moreover, it will be appreciated from the description herewith with reference to FIG. 4 that adjustment of the slide position toward the press bed is to be accompanied by adjustment of actuator rods 28 upwardly with respect to the slide assembly. Likewise, adjustment of the slide in the direction away from the press bed is to be accompanied by displacement of actuator rods 28 in the direction downwardly relative to the slide. Accordingly, the drive train from worm gear 76 to worm gears 146 and the thread relationships between worm gear 76 and worm wheel 46 and between worm gears 146 and worm wheels 126 are such as to provide such directional displacement in response to rotation of worm gear 76 in opposite directions. Still further, the thread relations referred to above together with the thread relation between shut height adjusting nut 48 and adjusting screw 54 and between worm wheels 126 and actuator rods 28 provide for displacing actuator rods 28 axially relative to slide assembly 16 a distance corresponding to the displacement of the slide assembly relative to the press bed. This of course assures maintenance of the desired positional relationship between cams 106 on the actuator rods and follower rollers 98 of the ejector mechanism.

In the embodiment disclosed, as shown in FIG. 6, one of the shaft portions 78 of worm gear 76 of the shut height adjusting mechanism is provided with a sprocket wheel 162 adapted to be driven by a reversible electric motor 164 mounted on a back plate of the press slide through a sprocket wheel 166 on the output shaft of the motor and a sprocket driven chain 168 trained about sprocket wheels 162 and 166. Shaft portions 78 at the opposite end of worm gear 76 is provided with a sprocket wheel 170 adapted to drive a shut height indicator 172 mounted on a front plate portion of the slide assembly through a sprocket driven chain 174 trained about sprocket wheel 170 and a sprocket wheel 176 associated with the indicator.

While considerable emphasis has been placed herein on the structure and structural interrelationship between the component parts of a preferred embodiment of the invention, other embodiments and modifications of the embodiment disclosed will be obvious and suggested to those skilled in the art and can be made without departing from the principles of the present invention. For example, it will be appreciated that the shut height adjusting mechanism and the actuator rod adjusting mechanisms could be driven independently of one other such as by separate motors with suitable controls to synchronize the slide and actuator rod displacements. Still further, it will be appreciated that the workpiece ejector mechanism could be associated with the slide rather than the press bed in which case the actuator rods would be axially adjustable relative to the press bed rather than the slide. Still further, with either the latter arrangement or the arrangement shown in the drawings, it will be appreciated that the actuator rods could be supported for rotation relative to the slide or press bed and against axial displacement relative thereto and that the cams and rods could be threadedly interengaged for rotation of the actuator rods to axially displace the cams relative to the rods. It will be further appreciated that the shut height adjusting mechanism could be manually operable such as by a crank as opposed to the preferred motor operation, and that ejector mechanism structures other than the mechanically actuated hydraulic arrangement herein illustrated and described can be employed.

Therefore, since many embodiments of the invention can be made and since many changes can be made in the embodiments herein illustrated and described, it is to be distinctly understood that the foregoing descriptive matter is to be interpreted merely as illustrative of the present invention and not as a limitation.

We claim:

1. In a press having a frame, slide means mounted on said frame for reciprocation toward and away from a bed on said frame to form a workpiece between tooling means on said bed and slide means, drive means for reciprocating said slide means, shut height adjusting means connecting said drive means to said slide means for adjusting the shut height of said slide means relative to said bed, workpiece ejecting means in one of said bed and slide means to eject a workpiece formed between said tooling means, and actuator means interconnecting the other of said bed and slide means with said ejecting means and having a given positional relationship with respect to said ejecting means to actuate said ejecting means in response to reciprocating of said slide means, the improvement comprising: actuator adjusting means for said actuator means, and means to drive said actuator adjusting means and said shut height adjusting means to change said shut height and to maintain said given positional relationship between said actuator means and said ejecting means.

2. The improvement according to claim 1, wherein said means to drive said actuator adjusting means and said shut height adjusting means includes means driving said actuator adjusting means and shut height adjusting means in synchronism.

3. The improvement according to claim 1, wherein said actuator adjusting means is carried on said slide means and said means to drive said actuator adjusting means and said shut height adjusting means includes common drive means therefor on said slide means.

4. The improvement according to claim 1, wherein said actuator means includes rod means carried by said other of said bed and slide means, and said actuator adjusting means includes means interengaged with said rod means to displace said rod means relative to said other of said bed and slide means upon driving said actuator adjusting means.

5. The improvement according to claim 4, wherein said slide means is the other of said bed and slide means and said actuator adjusting means is on said slide means.

6. The improvement according to claim 1, wherein said ejecting means is in said bed and said actuator means includes rod means mounted on said slide means for reciprocation therewith and relative to said ejecting means, said actuator adjusting means including means supporting said rod means on said slide means for adjustment relative thereto in the direction of reciprocation of said slide means.

7. The improvement according to claim 1, wherein said shut height adjusting means includes a first rotatable member on said slide means and said actuator adjusting means includes a second rotatable member on said slide means, and wherein said means to drive said shut adjusting and actuator adjesting means includes means to rotate one of said first and second rotatable members and means coupling said rotatable members for rotation of said one member to rotate the other.

8. The improvement according to claim 7, wherein said first rotatable member is said one member.

9. The improvement according to claim 7, wherein said actuator means includes rod means extending in the direction of reciprocation of said slide means and interengaged with said second rotatable member for rotation of said second member to displace said rod means relative to said slide means in said direction.

10. In a press having a frame, slide means mounted on said frame for reciprocation toward and away from a bed on said frame to form a workpiece between tooling means on said bed and slide means, drive means for reciprocating said slide means, shut height adjusting means connecting said slide means to said drive means for adjusting the shut height of said slide means relative to said bed, means to drive said shut height adjusting means, workpiece ejecting means supported by said bed to eject a workpiece formed between said tooling means, and actuator means carried by said slide means for reciprocation therewith and including means having a given positional relationship with respect to said ejecting means to actuate said ejecting means in response to reciprocation of said slide means, the improvement comprising: driven actuator adjusting means connecting said actuator means to said slide means for movement therewith, and means coupling said actuator adjusting means with said means to drive said shut height adjusting means for said shut height and actuator adjusting means to be driven simultaneously to adjust said shut height and to maintain said given positional relationship in response to adjustment of said shut height.

11. The improvement according to claim 10, wherein said actuator means includes rod means extending from said slide means toward said bed, and said actuator adjusting means interengages said rod means to axially displace said rod means relative to said slide means upon driving of said actuator adjusting means.

12. The improvement according to claim 11, wherein said actuator adjusting means includes a rotatable member mounted on said slide for rotation about an axis parallel to the direction of reciprocation of said slide means.

13. The improvement according to claim 11, wherein said actuator adjusting means includes a rotatable member mounted on said slide, said member and rod means being threadedly interengaged for rotation of said member to axially displace said rod means relative to said slide means.

14. The improvement according to claim 13, wherein said rotatable member and said rod means are coaxial, and means mounting said rotatable member on said slide means against displacement axially of the axis of rotation of said member.

15. The improvement according to claim 14, wherein said rotatable member has an internally threaded opening therethrough receiving an externally threaded portion of said rod means.

* * * * *